US012484694B2

(12) United States Patent
Meyer

(10) Patent No.: US 12,484,694 B2
(45) Date of Patent: Dec. 2, 2025

(54) SLIDEABLE KEYBOARD TRAY WITH TILT ADJUSTMENT

(71) Applicant: CKnapp Sales, Inc., Goodfield, IL (US)

(72) Inventor: Brandon Meyer, Normal, IL (US)

(73) Assignee: CKnapp Sales, Inc., Goodfield, IL (US)

( * ) Notice: Subject to any disclaimer, the term of this patent is extended or adjusted under 35 U.S.C. 154(b) by 360 days.

(21) Appl. No.: 18/132,364

(22) Filed: Apr. 7, 2023

(65) Prior Publication Data

US 2024/0335031 A1 Oct. 10, 2024

(51) Int. Cl.
*A47B 21/03* (2006.01)

(52) U.S. Cl.
CPC .. *A47B 21/0314* (2013.01); *A47B 2021/0321* (2013.01); *A47B 2021/0335* (2013.01); *A47B 2210/15* (2013.01)

(58) Field of Classification Search
CPC ..... A47B 21/0314; A47B 2021/0321; A47B 2021/0335; A47B 2210/15; A47B 2021/0364; A47B 21/0371; A47B 2021/0328; A47B 2200/009; Y10S 248/918; Y10S 248/92; Y10S 248/921; Y10S 248/922; Y10S 248/923
See application file for complete search history.

(56) References Cited

U.S. PATENT DOCUMENTS 102,938 A 5/1870 Heminway et al.
2,671,910 A 3/1954 Frank
2,703,265 A 3/1955 Wolfe
3,220,592 A 11/1965 Powell et al.
3,865,336 A 2/1975 Robertson
4,625,657 A * 12/1986 Little ..... A47B 21/0314 108/138
4,736,689 A * 4/1988 Stanko ..... A47B 21/0314 312/246
4,923,259 A 5/1990 Bartok
4,988,066 A 1/1991 Cotterill
D318,390 S 7/1991 Murray
(Continued)

FOREIGN PATENT DOCUMENTS

CA 2671910 A1 12/2008
CN 208172737 U 11/2018
(Continued)

OTHER PUBLICATIONS

Black Clamp-on Keyboard Tray: Instruction Manual: SKU: MOUNT-KB05E; Aug. 25, 2021; 4 pages; VIVO; Goodfield, Illinois.
(Continued)

*Primary Examiner* — Hiwot E Tefera
(74) *Attorney, Agent, or Firm* — Lund IP PLLC

(57) ABSTRACT

An adjustable keyboard tray includes a desk mount configured to secure the adjustable keyboard tray to a desktop, a slide including a fixed rail attached to the desk mount and a slidable rail slidably mated with the fixed rail, a keyboard platform mount attached to the slidable rail with a keyboard platform mount pivot, and a keyboard platform attached to the keyboard platform mount, the keyboard platform being slidable relative to the desk mount via the slide and tiltable relative to the slide via the keyboard platform mount pivot.

18 Claims, 11 Drawing Sheets

(56) References Cited

U.S. PATENT DOCUMENTS

| | | | | |
|---|---|---|---|---|
| 5,037,163 | A * | 8/1991 | Hatcher | A47B 21/0314 248/371 |
| 5,098,053 | A | 3/1992 | Cotterill | |
| 5,211,367 | A | 5/1993 | Musculus | |
| D337,907 | S | 8/1993 | Page | |
| 5,273,250 | A * | 12/1993 | Pemberton | A47B 21/0314 108/5 |
| 5,292,097 | A | 3/1994 | Russell | |
| 5,294,087 | A * | 3/1994 | Drabczyk | A47B 21/0314 108/138 |
| 5,447,146 | A | 9/1995 | Nickerson | |
| D364,290 | S | 11/1995 | Watts | |
| 5,513,824 | A * | 5/1996 | Leavitt | A47B 21/0371 400/715 |
| 5,533,820 | A * | 7/1996 | Ambrose | B41J 5/10 400/715 |
| 5,653,413 | A * | 8/1997 | Fink | A47B 21/0314 248/286.1 |
| 5,661,605 | A | 8/1997 | Conway | |
| 5,707,034 | A | 1/1998 | Cotterill | |
| 5,720,230 | A | 2/1998 | Mansfield | |
| 5,771,814 | A | 6/1998 | Clausen | |
| 5,836,562 | A | 11/1998 | Danzyger et al. | |
| 5,961,231 | A | 10/1999 | Ambrose | |
| 6,079,676 | A | 6/2000 | Hackett et al. | |
| 6,092,774 | A * | 7/2000 | Choy | A47B 21/0314 248/176.1 |
| 6,109,571 | A * | 8/2000 | Hirschovits | A47B 21/0314 248/231.71 |
| 6,116,557 | A * | 9/2000 | Choy | A47B 21/0314 108/93 |
| 6,135,404 | A | 10/2000 | Wisniewski et al. | |
| 6,206,464 | B1 * | 3/2001 | Santa Rosa | A47C 7/68 297/173 |
| 6,273,382 | B1 | 8/2001 | Pemberton | |
| 6,419,197 | B2 | 7/2002 | Kochanski et al. | |
| 6,454,369 | B1 | 9/2002 | Cooper et al. | |
| 6,874,736 | B1 | 4/2005 | Jones et al. | |
| 7,121,516 | B1 * | 10/2006 | Koh | F16M 13/022 248/227.2 |
| 7,516,923 | B2 | 4/2009 | Rossini | |
| 7,673,839 | B2 | 3/2010 | Zhang et al. | |
| 7,946,551 | B1 * | 5/2011 | Cvek | A47B 21/0314 248/118 |
| 8,061,668 | B1 | 11/2011 | Cvek | |
| 8,740,166 | B2 | 6/2014 | Hamilton et al. | |
| D840,182 | S | 2/2019 | Warden et al. | |
| D861,403 | S | 10/2019 | Hurford | |
| 10,610,010 | B2 | 4/2020 | Matlin et al. | |
| 10,798,844 | B2 * | 10/2020 | Lee | H05K 5/0221 |
| 10,820,692 | B2 | 11/2020 | Ho et al. | |
| D916,517 | S | 4/2021 | Lozada | |
| D928,795 | S | 8/2021 | Zhang | |
| 2002/0017594 | A1 * | 2/2002 | DiOrio, Jr. | G06F 3/0395 248/118 |
| 2002/0195907 | A1 * | 12/2002 | Lawson | A47D 5/00 312/107 |
| 2003/0042380 | A1 * | 3/2003 | Hagglund | A47B 21/0314 108/138 |
| 2003/0084828 | A1 * | 5/2003 | Gillis | A47B 21/0314 108/137 |
| 2005/0103960 | A1 * | 5/2005 | Kirchhoff | A47B 21/0314 108/138 |
| 2005/0285004 | A1 | 12/2005 | Elgie et al. | |
| 2007/0001077 | A1 | 1/2007 | Kirchhoff | |
| 2013/0340655 | A1 | 12/2013 | Flaherty | |
| 2016/0040739 | A1 | 2/2016 | Smith et al. | |
| 2017/0295924 | A1 * | 10/2017 | Getz | A47B 97/00 |
| 2020/0107634 | A1 | 4/2020 | Hendrix et al. | |
| 2020/0187638 | A1 | 6/2020 | Ho et al. | |
| 2022/0151375 | A1 * | 5/2022 | Fehr | A47B 21/0314 |
| 2024/0335031 | A1 | 10/2024 | Meyer | |

FOREIGN PATENT DOCUMENTS

| | | | |
|---|---|---|---|
| CN | 208689549 | U | 4/2019 |
| CN | 209587504 | U | 11/2019 |
| JP | 3220592 | U | 3/2019 |
| WO | 0102938 | A1 | 1/2001 |
| WO | 2016040739 | A1 | 3/2016 |

OTHER PUBLICATIONS

Black Clamp-on Tilting Keyboard Tray: Instruction Manual: SKU: MOUNT-KB07T; Aug. 27, 2021; 4 pages; VIVO; Goodfield, Illinois.

Mount-It! MI-7143 Easy Clamp on Keyboard Tray; 2 pages, Oct. 29, 2018; accessed online at https://downloads.mount-it.com/pub/media/datasheets/datasheet_MI-7143.pdf on Apr. 8, 2023.

Universal Clamp-On Pull Out Keyboard Tray; web page: https://www.standupdeskstore.com/ergonomic-clamp-on-pull-out-keyboard-tray; 14 pages, Feb. 2, 2022; Stand Up Desk Store; retrieved from Internet Archive: https://web.archive.org/web/20220202172159/https://www.standupdeskstore.com/ergonomic-clamp-on-pull-out-keyboard-tray on Apr. 7, 2023.

* cited by examiner

SLIDEABLE KEYBOARD TRAY WITH TILT ADJUSTMENT

TECHNICAL FIELD

This disclosure relates to keyboard trays for desktops.

BACKGROUND

Keyboard trays mounted below desktops free up desktop space and facilitate ergonomic positioning of keyboards for users.

BRIEF SUMMARY

Keyboard trays disclosed herein include a slidable rail with a keyboard platform mount pivot. A keyboard platform attached to the keyboard platform mount is both slidable via the slide and tiltable relative to the slide via the keyboard platform mount pivot.

In one example, an adjustable keyboard tray includes a desk mount configured to secure the adjustable keyboard tray to a desktop, a slide including a fixed rail attached to the desk mount and a slidable rail slidably mated with the fixed rail, a keyboard platform mount attached to the slidable rail with a keyboard platform mount pivot, and a keyboard platform attached to the keyboard platform mount, the keyboard platform being slidable relative to the desk mount via the slide and tiltable relative to the slide via the keyboard platform mount pivot.

In another example, a desktop assembly includes a desktop and an adjustable keyboard tray. The adjustable keyboard tray includes a desk mount securing the adjustable keyboard tray to the desktop, a slide including a fixed rail attached to the desk mount and a slidable rail slidably mated with the fixed rail, a keyboard platform mount attached to the slidable rail with a keyboard platform mount pivot, and a keyboard platform attached to the keyboard platform mount, the keyboard platform being slidable relative to the desk mount and the desktop via the slide and tiltable relative to the slide and the desktop via the keyboard platform mount pivot.

DETAILED DESCRIPTION

Figure 1A:
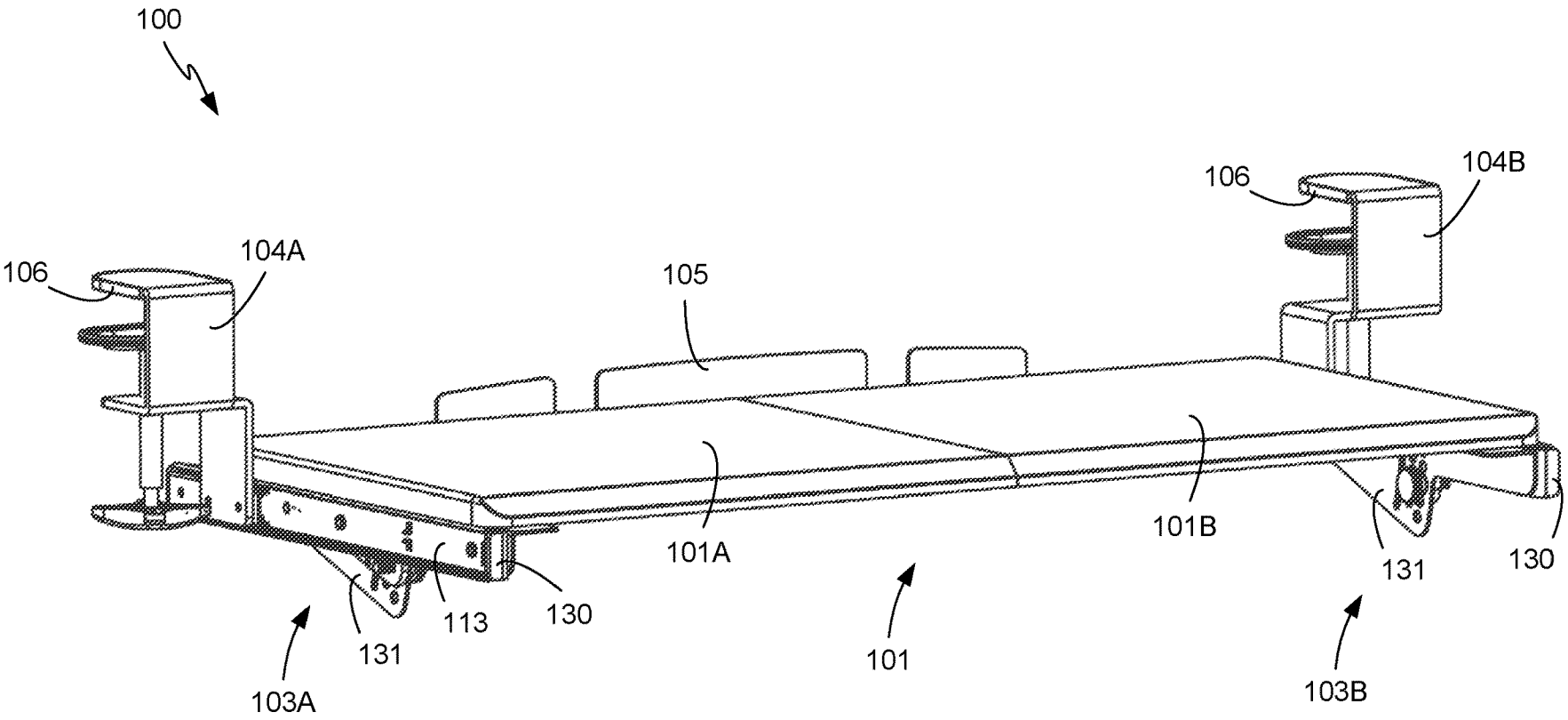
FIGS. 1A-1C illustrate an adjustable keyboard tray with clamp desk mounts and components thereof.

FIG. 1A illustrates an adjustable keyboard tray 100. Adjustable keyboard tray 100 includes a keyboard platform 101 formed from keyboard platform sections 101A, 101B. The keyboard platform 101 is sized to support a keyboard. Some examples may be sized to support a keyboard and a computer mouse. For example, an upper surface of the keyboard platform 101 may have a width of 14 to 36 inches and a depth of 5 to 16 inches. The keyboard platform 101 includes a keyboard stop 105 extending upwards proximate a rear edge of the keyboard platform 101. The keyboard stop 105 is configured to prevent a keyboard from sliding off the back of the upper surface of the keyboard platform 101. The keyboard stop 105 includes two slits which may constrain wires for a keyboard, computer mouse, or other equipment placed on the upper surface of the keyboard platform 101.

In some examples, keyboard platform 101 may be primarily formed from a wood product. For example, the wood product may include natural wood, plywood, and/or a fiberboard comprising wood particles and a binding agent. Such fiberboards include medium density fiberboard (MDF). Some of such examples may include a laminate over at least a portion of the wood product, such as a laminate forming the upper platform surface.

As compared to other design incorporating primarily plastic materials, the wood product may provide increased rigidity as well as facilitate unique shapes. For example, while plastic components must have tapered side surfaces to allow removal from a mold, surfaces of keyboard platform sections 101A, 101B may form right angles relative to each other and an ergonomically tapered front edge. In another variation, all or portions of the side surfaces of keyboard platform sections 101A, 101B may include a rounded, convex, surface formed by edge banding between the upper surfaces and the undersides. The edge banding covers and seals the side surfaces of the base material, providing protection and improving the appearance of the product.

Figure 3A:
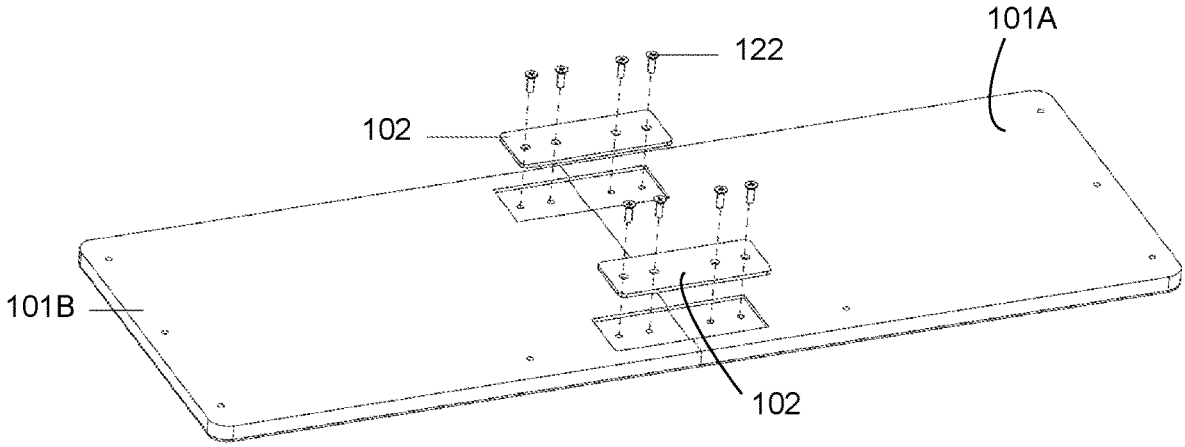
FIGS. 3A-3G illustrate steps for assembling an adjustable keyboard tray with a clamp desk mount and a desktop.
Figure 3B:
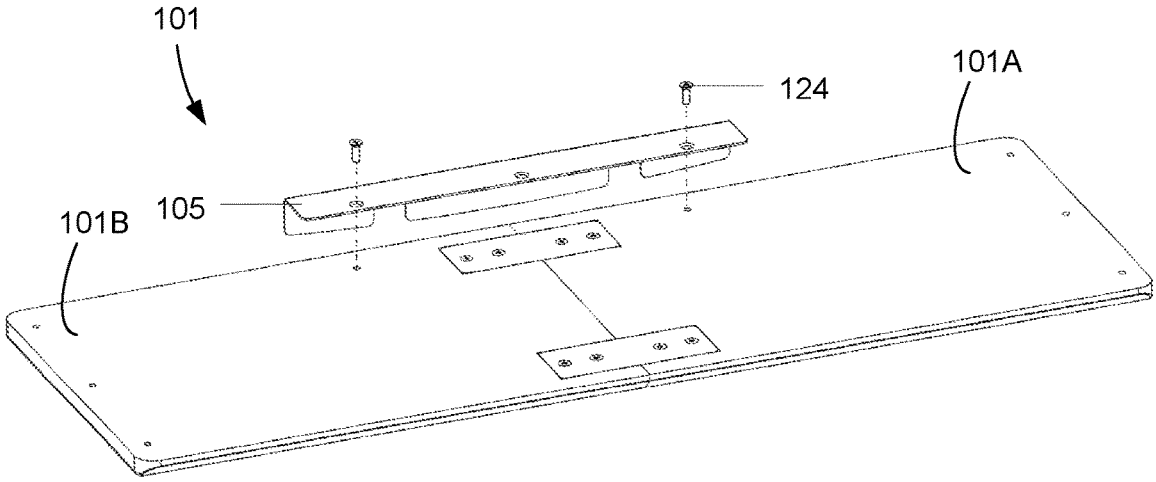
Figure 3C:
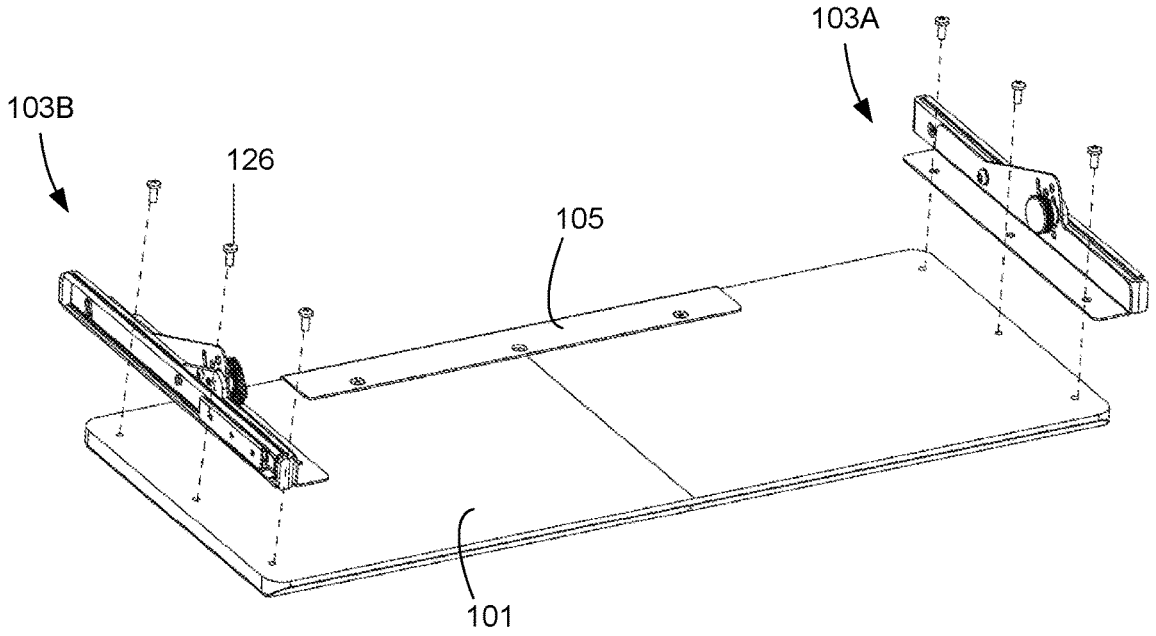
Figure 3D:
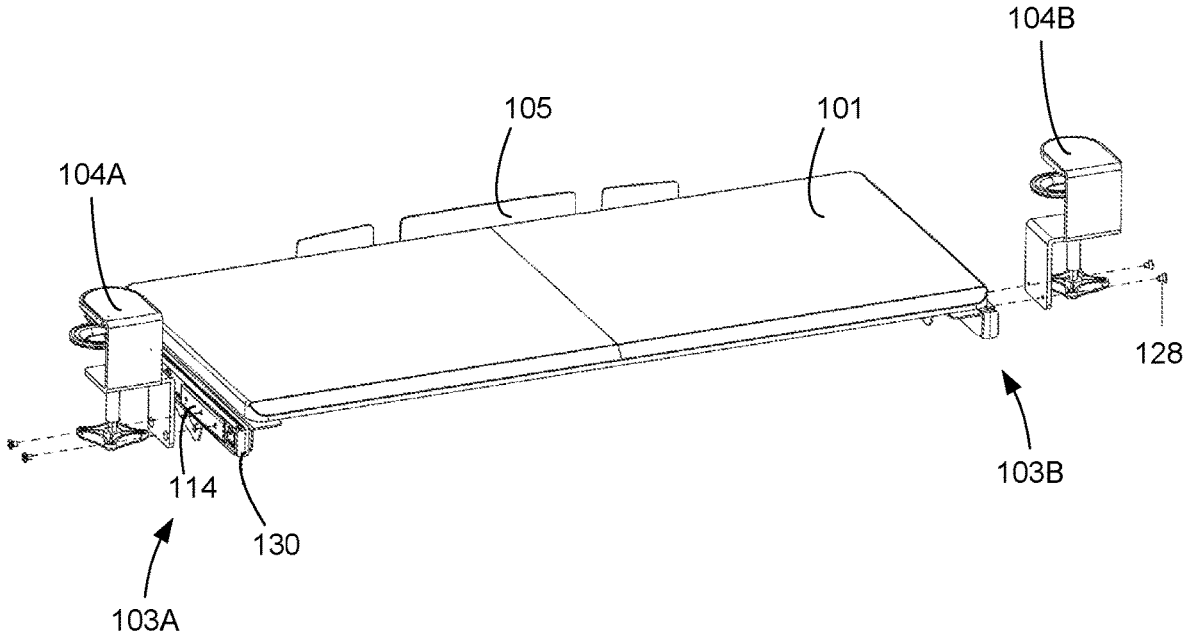
Figure 3E:
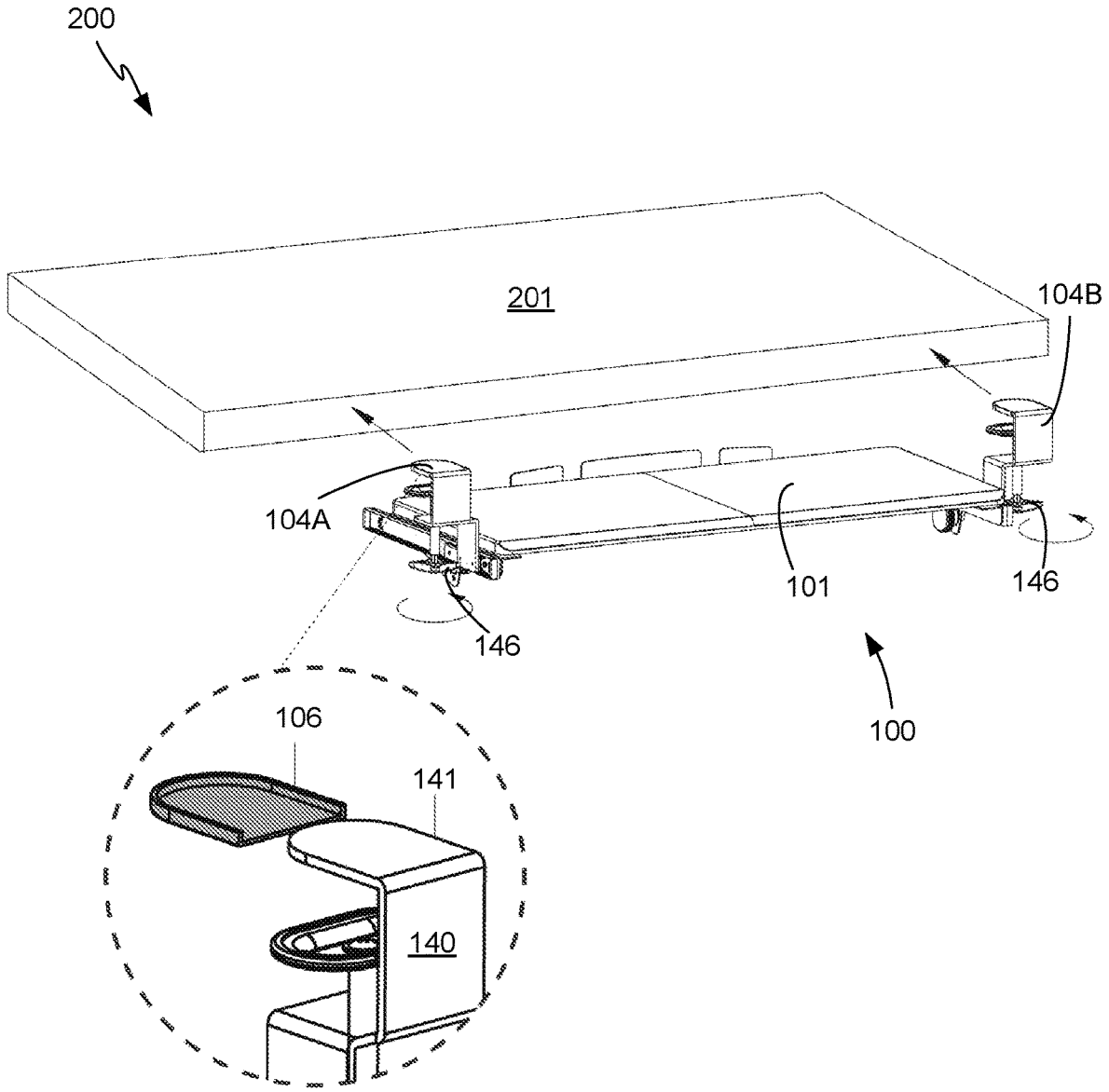

Adjustable keyboard tray 100 includes two clamps 104A, 104B (collectively, "clamps 104"), which function as desk mounts to secure the adjustable keyboard tray 100 by engaging an edge of a desktop, such as desktop 201 (FIG. 3E). Each clamp 104 includes a C-shaped clamp bracket 140 with an upper clamping surface 141 and a threaded aperture 142 on the opposing side of the C-shaped clamp bracket 140. Optional clamp pads 106 are positioned over upper clamping surface 141 of the clamp brackets 140 to protect a topside of a desktop from the clamps 104. The hand screw 146 includes a threaded shaft engaged with the threaded aperture 142 and a pivoting clamp foot 148 with a lower clamping surface of the clamp 104. A user turns the hand screw 146 to tighten and loosen the clamp 104. A mounting tab 144 extends below each clamp 104 and is attached to a fixed rail 114 of the adjustable keyboard tray 100. The mounting tab 144 may be fixed to the fixed rail 114 via any suitable method, including, but not limited to, snap-fit connection, bolts, rivets, welding, adhesive or epoxy. In some examples, the clamp brackets 140 may be formed as a unitary component with mounting tab 144 from a bent sheet metal.

Figure 4:
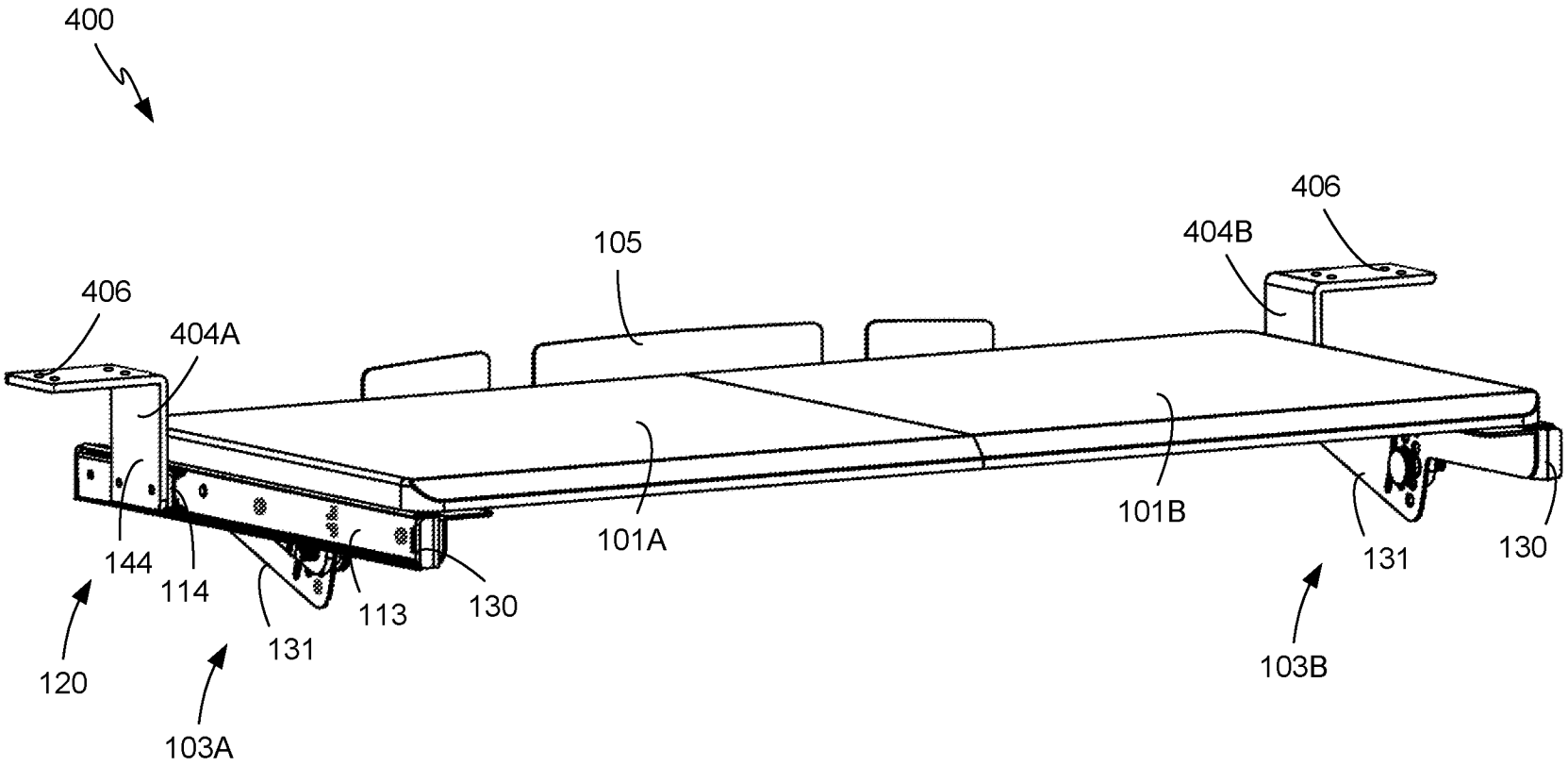
FIG. 4 illustrates an adjustable keyboard tray with bracket desk mounts and components thereof.

Alternative designs for adjustable keyboard tray 100 can include any variety of desk mounts, in addition to or instead of clamps 104. Such varieties of desk mounts include but are not limited to, brackets and screws as described with respect to adjustable keyboard tray 400 (FIG. 4).

The fixed rail 114 is one component of a right tilting track 103A, and a left tilting track 103B, (collectively, "tilting tracks 103") of the adjustable keyboard tray 100. The tilting tracks 103 include the same components, but in a reversed, mirrored orientation relative to each other. Each tilting track 103 includes a slide 120 with a fixed rail 114 attached to one of the clamps 104. Each slide 120 includes a slideable rail 130 with a channel track 113 to receive the fixed rail 114 such that slideable rail 130 is slideably mated with the fixed rail 114. The channel track 113 may be fixed to the bent frame of slideable rail 130 via any suitable method, including, but not limited to, snap-fit connection, bolts, rivets, welding, adhesive or epoxy. Other examples of adjustable keyboard tray 100 may include different slide configurations, including, but not limited to, linear rails with bearing slides, a top track with hanging roller sides, and a bottom track with roller slides.

A keyboard platform mount 131 is attached to each slidable rail 130 with a keyboard platform mount pivot 109. The keyboard platform 101 is attached to each keyboard platform mount 131, spanning the gap therebetween. The keyboard platform 101 is slidable relative to the clamps 104 via the slide 120 and tiltable relative to the slide 120 via the keyboard platform mount pivot 109. The slides 120 allow an operator to apply a force to move the keyboard platform 101 in a horizontal motion to locate the keyboard platform 101 closer to or further away from the operator. The slides 120 operate in parallel for horizontal adjustments the keyboard platform 101. Likewise, the keyboard platform mount pivots 109 operate in parallel for tilt adjustments of the keyboard platform 101.

The adjustable keyboard tray 100 further includes a tilt lock to fix a tilt setting of the keyboard platform 101 relative to the slide 120. The tilt lock includes a tilt locking thumb screw 107 including a threaded shaft extending through one of a plurality of holes 136 in the keyboard platform mount 131 and engaged with a threaded hole in the slidable rail 130. Each of the plurality of holes 136 provide a different preset tilt setting for the keyboard platform 101. An optional washer 108 over the threaded shaft of thumb screw 107 provides an interference fit thumb screw 107 and operates to protect the interface of the thumb screw 107 and the keyboard platform mount 131 at the selected hole 136.

Figure 1B:
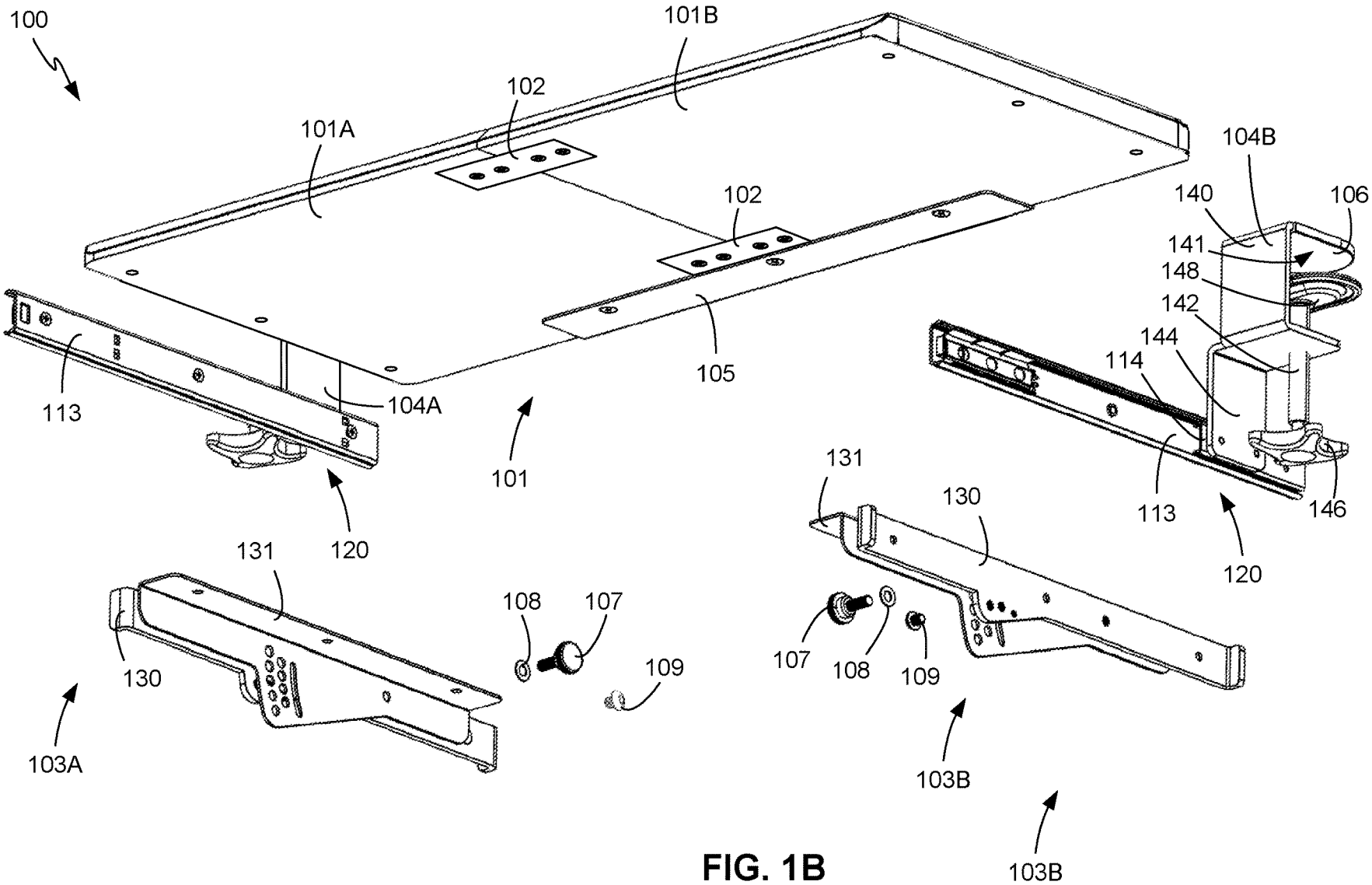
Figure 1C:
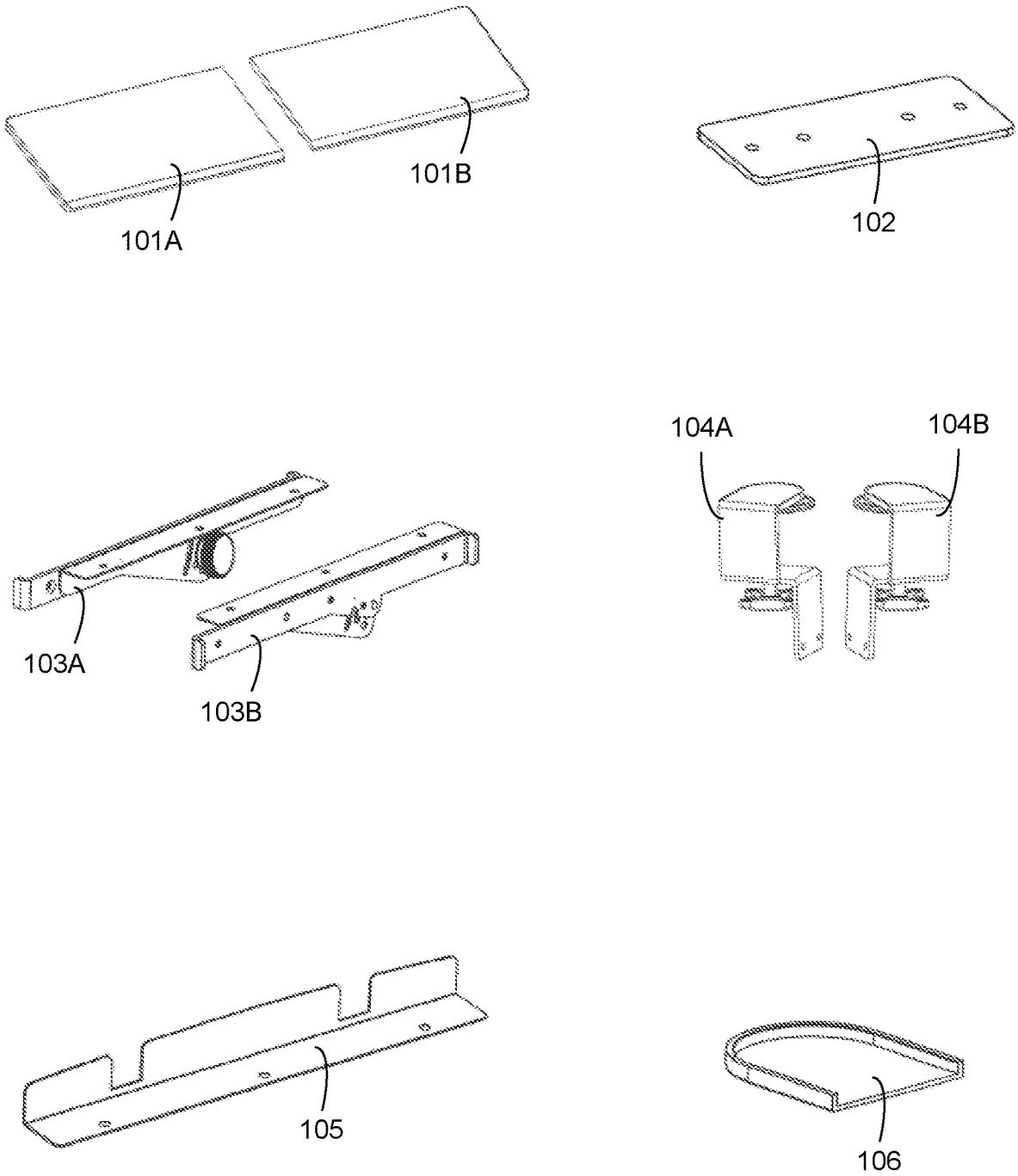

In some examples, adjustable keyboard tray 100 may be sold as a kit without a separate desktop. Separate components in an example kit for adjustable keyboard tray 100 are shown in FIG. 1C. These components include:

Keyboard platform sections 101A, 101B (1 each)
Connecting plate 102 (×2)
Tilting tracks 103A, 103B (1 each)
Clamps 104A, 104B (1 each)
Keyboard stop 105 (×1)
Clamp pad 106 (×2)

The keyboard platform 101 includes two keyboard platform 101 sections 101A, 101B joined with connecting plates 102 that span a joint between the two keyboard platform 101 sections 101A, 101B along an underside of the keyboard platform 101. Other examples may include a unitary keyboard platform 101, rather than two keyboard platform sections 101A, 101B. The use of keyboard platform sections 101A, 101B facilitates a reduced overall package dimensions for the kit for adjustable keyboard tray 100 prior to final assembly by a customer. In some examples, a packaging size with a maximum box length of 18 inches may reduce shipping expenses compared to designs requiring larger packaging.

Figure 2A:
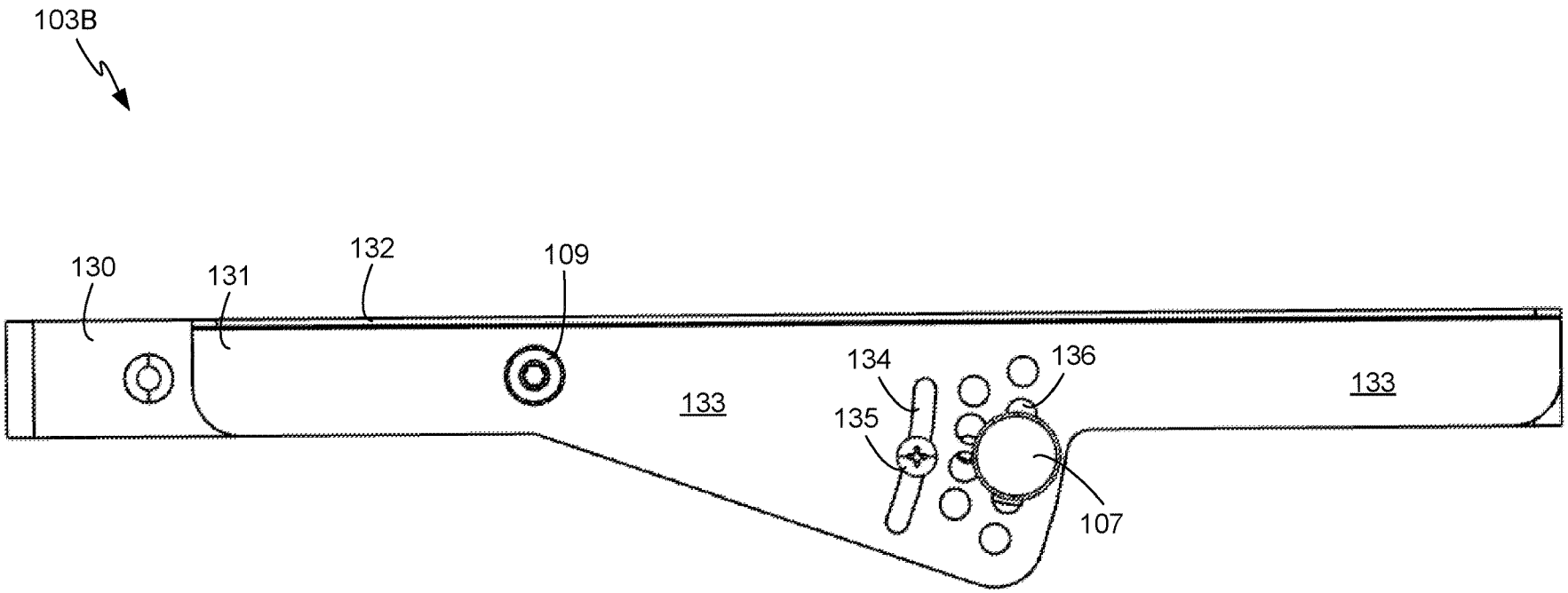
FIGS. 2A-2C illustrate a track assembly for an adjustable keyboard tray with a clamp desk mount.
Figure 2B:
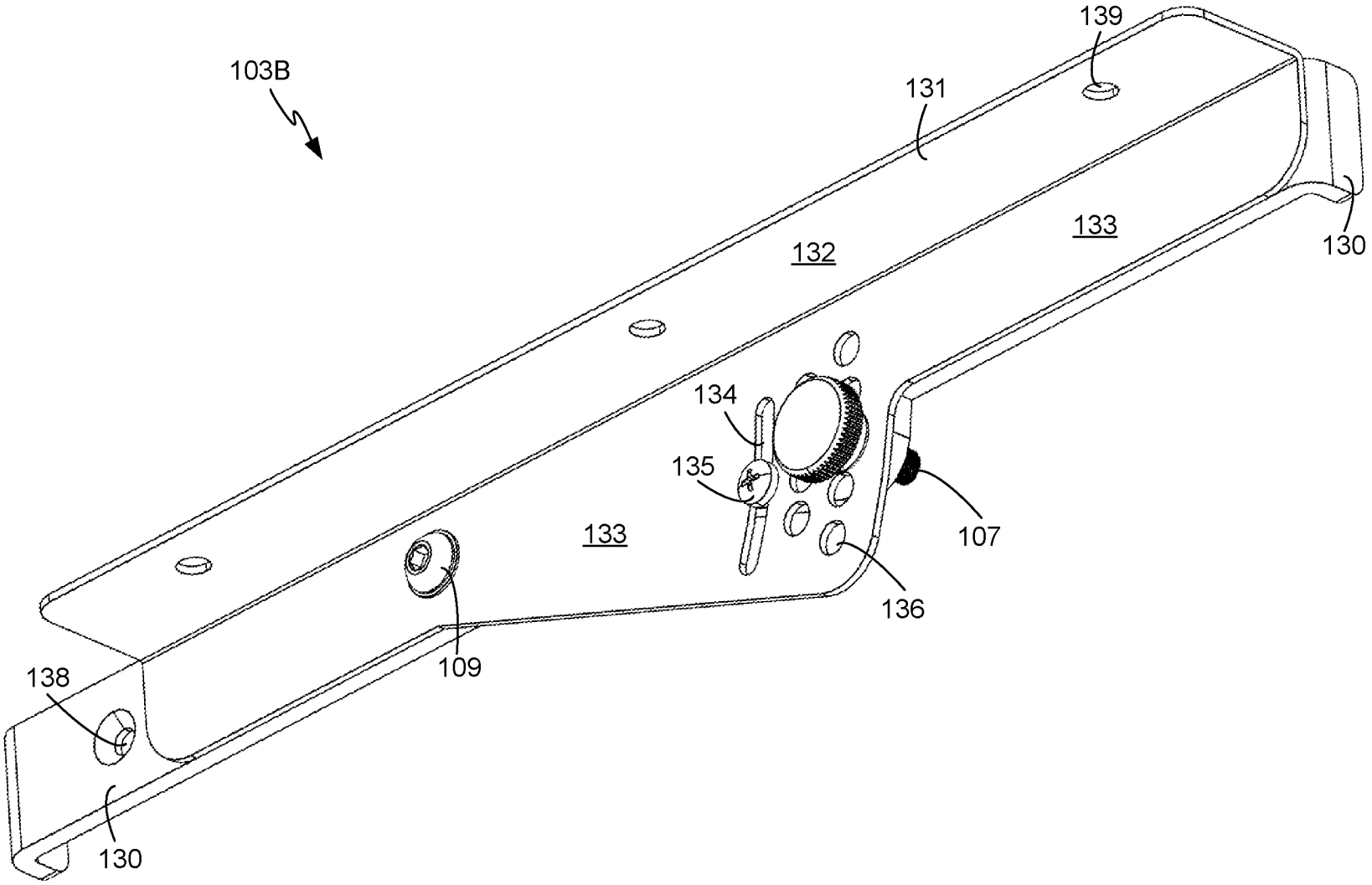
Figure 2C:
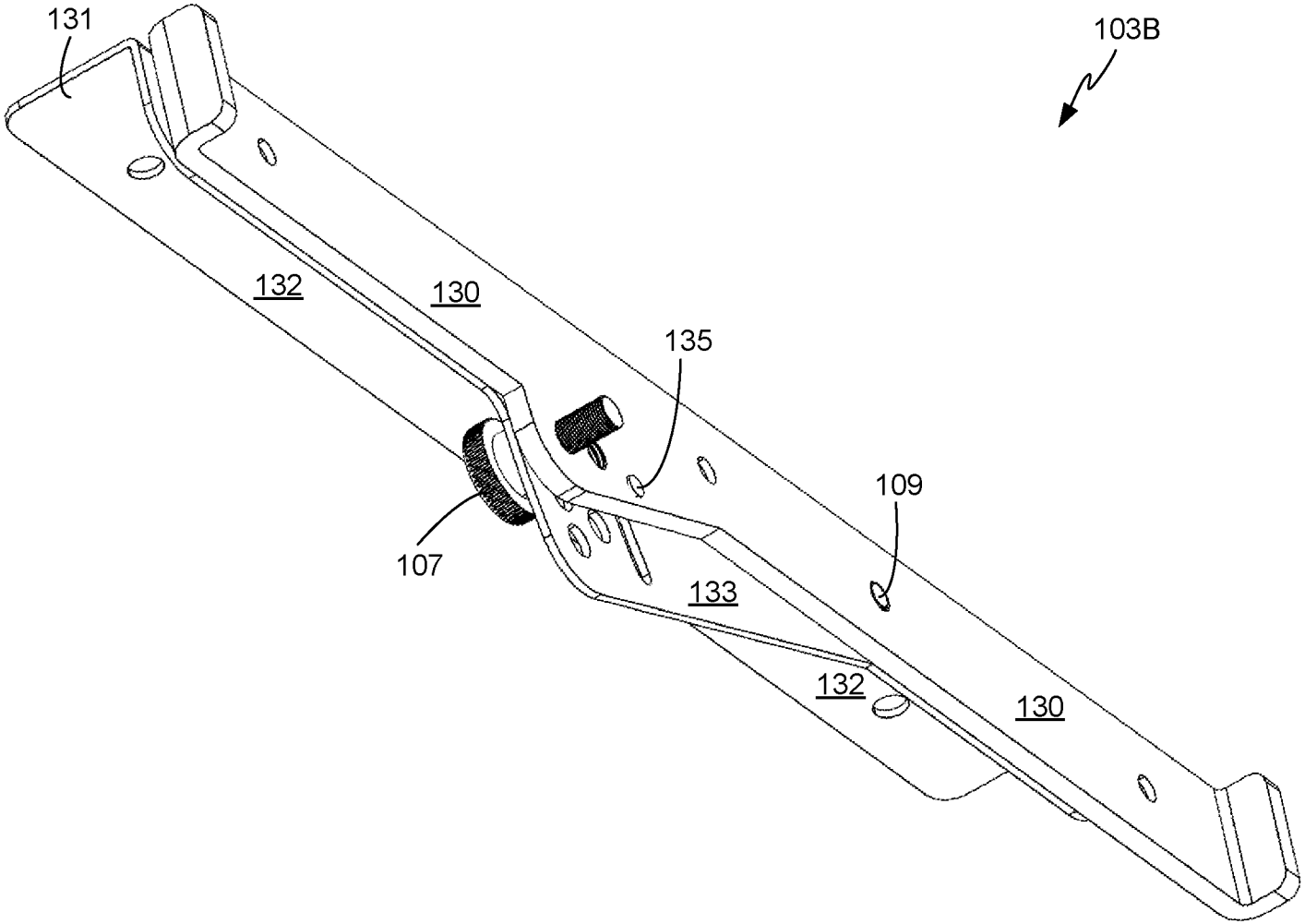

FIGS. 2A-2C illustrate the left tilting track 103B of adjustable keyboard tray 100. The left tilting track 103B is representative of the right tilting track 103A of adjustable keyboard tray 100, except the components of the right tilting track 103A of adjustable keyboard tray 100 are mirrored. For brevity, the right tilting track 103A is not described separately.

Tilting track 103B includes a slidable rail 130 attached to a keyboard platform mount 131 with a keyboard platform mount pivot 109. In the illustrated example, pivot 109 is formed from a rivet through holes in both slidable rail 130 and keyboard platform mount 131. Other pivot connections can also be used, such as, but not limited to, bolts and locknuts, pins, a solid axel protruding from one of slidable rail 130 or keyboard platform mount 131 and extending through a hole in the other, binding screw mated to a binding post through holes in both slidable rail 130 and keyboard platform mount 131, a linkage, such as a four-bar linkage, or other pivot connection.

The keyboard platform mount 131 is formed from a unitary sheet metal with a bend separating an upper mount section 132 from a rail section 133. The upper mount section 132 include screw holes 139 for mounting keyboard platform 101. The rail section 133 includes holes for pivot 109 and holes 136 for thumb screw 107. The rail section 133 also includes an elongated radial slot 134 to receive pivot limit screw 135. The thumb screw 107 and the pivot limit screw 135 engage threaded holes in slideable rail 130. To facilitate more refined adjustment, holes 136 for thumb screw 107 are aligned on two separate radii relative to pivot 109, the holes 136 at each radii are aligned with one of two threaded holes in in slideable rail 130. Slideable rail 130 includes recessed screw holes 138 to attach the channel track 113 (FIG. 1).

Figure 3F:
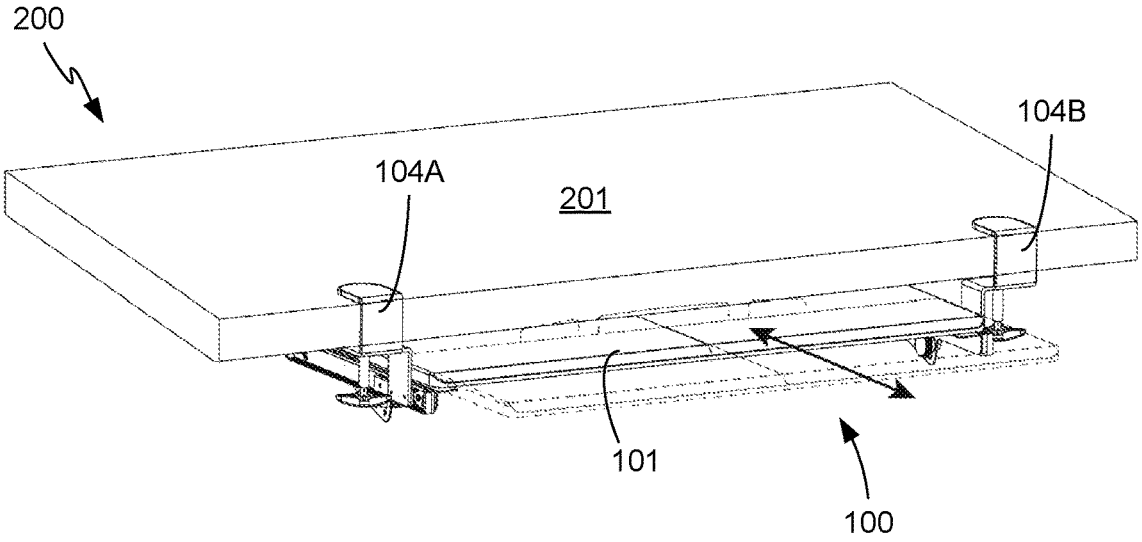
Figure 3G:
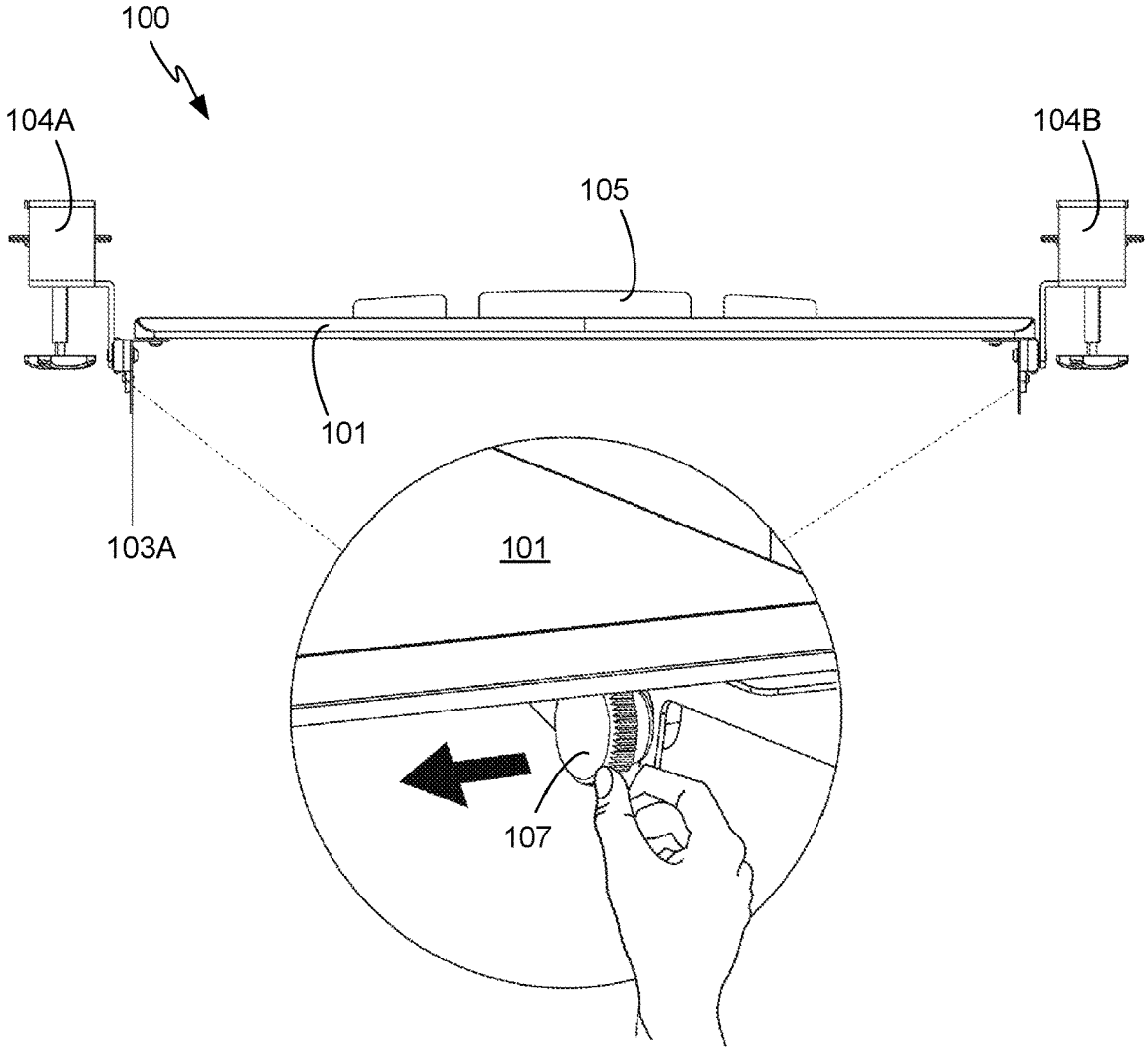

FIGS. 3A-3G illustrate steps for assembling adjustable keyboard tray 100 and a desktop 201 to form a desktop assembly 200. Specifically, FIGS. 3A-3D illustrate steps for assembling adjustable keyboard tray 100, FIG. 3E illustrates the step of attaching the adjustable keyboard tray 100 to desktop 201 to form a desktop assembly 200, FIG. 3F illustrates sliding keyboard platform 101 to adjust a horizontal position of the keyboard platform 101 relative to the clamps 104 and the desktop 201, and FIG. 3G illustrates tilting keyboard platform 101 to adjust an angle of the keyboard platform 101 relative to the clamps 104 and the desktop 201. The description of FIGS. 3A-3G includes example details, such as screws and detailed dimensions; however, any suitable fixation mechanisms may be used, and the techniques of this disclosure may be adapted for any desired dimensions.

FIG. 3A illustrates joining keyboard platform sections 101A, 101B with connecting plates 102 using screws 122. FIG. 3B illustrates attaching keyboard stop 105 to keyboard platform 101 with screws 124. FIG. 3C illustrates attaching right tilting track 103A and left tilting track 103B to keyboard platform 101 with screws 126. Keyboard platform sections 101A, 101B include recesses sized to receive connecting plates 102 and optional predrilled holes for screws 122. Likewise, keyboard platform 101 includes optional predrilled holes for screws 124, 126.

FIG. 3D illustrates attaching clamps 104 to tilting tracks 103 using screws 128. Screws 128 extend through holes in mounting tabs 144 of each clamp 104 and engage threaded holes in fixed rails 114 of tilting tracks 103.

FIG. 3E illustrates steps for attaching adjustable keyboard tray 100 to desktop 201 to form desktop assembly 200. First, the assembly process includes positioning optional clamp pads 106 over upper clamping surface 141 of the clamp brackets 140 to protect a topside of a desktop from the clamps 104. For example, clamp pads 106 may be formed from a compliant material such an elastomer, foam, or rubber material.

Next, the assembly process includes securing adjustable keyboard tray 100 to the desktop 201 with clamps 104. Specifically, a user positions the clamps 104 over the edge of the desktop 201 and turns the hand screws 146 to tighten the clamps 104 to engage the edge of the desktop 201. With adjustable keyboard tray 100 secured to the desktop 201, FIG. 3F illustrates horizontal adjustment of keyboard platform 101. A user pulls the keyboard platform 101 to bring it forward to a protruding position out and down from the upper work surface of the desktop 201. The protruding position provides a user easy access to a keyboard or other items on the keyboard platform 101. A portion of the keyboard platform 101 may remain underneath the profile of desktop 201 in the in the protruding position out and down from the upper work surface of the desktop 201. The user pushes the keyboard platform 101 to move it backwards to a stored position underneath the profile of desktop 201.

FIG. 3G illustrates tilt adjustment of the keyboard platform 101. A user removes both thumb screws 107 from the tilting tracks 103 to facilitate the tilt adjustment. Then the user pivots the keyboard platform about the pivots 109 to select a tilt for the keyboard platform 101. The pivot limit screw 135 within elongated radial slot 134 is not tightly engaged with keyboard platform mount 131 but limits the range of the tilt adjustment.

At the selected tilt position of the keyboard platform 101, the user aligns one of the holes 136 in the keyboard platform mount 131 and with a threaded hole in the slidable rail 130. For each tilting track 103, the user pushes then installs both thumb screws 107 through the aligned holes 136 into the threaded hole in the slidable rail 130 and tightens the thumb screws 107. The tilt of the keyboard platform 101 is locked by the thumb screws 107.

In an alternative example, tilt adjustment may include a friction lock, spring lock or pin lock rather than the screw lock through holes 136. In an example friction lock configuration, thumb screws 107 may extend through radial slots to provide infinite adjustment points for the tilt rather than the present tilt adjustments provided by holes 136. However, the use of holes 136 in the keyboard platform mount 131 (in combination with a screw, solid pin, or depressible spring pin), may provide more stability for the keyboard platform 101 at the selected the tilt adjustment than other examples utilizing a friction lock with a radial slot instead of holes 136.

The locked tilt adjustment provided by adjustable keyboard 100 allows users to set keyboard platform 101 at the most ergonomic position for their individual preferences and workspace.

FIG. 4 illustrates an adjustable keyboard tray 400. Adjustable keyboard tray 400 is substantially similar to adjustable keyboard tray 100 except that two brackets 404A, 404B (collectively, "brackets 404") replace clamps 104. For brevity, details regarding the adjustable keyboard tray 100 are not repeated with respect to the adjustable keyboard tray 400.

Brackets 404 function as desk mounts to secure the adjustable keyboard tray 400 to the underside of a desktop, such as desktop 201 (FIG. 3E). For example, a front edge of the brackets 404 may be aligned with or proximate to a front edge of the underside of the desktop. Each of brackets 404 includes screw holes 406 to receive screws that engage the underside of the desktop, thereby attaching the brackets 404 to the underside of the desktop. Like clamps 104, each bracket 404 includes a mounting tab 144 for attachment to a fixed rail 114. The mounting tabs 144 of brackets 404 may be fixed to the fixed rail 114 via any suitable method, including, but not limited to, snap-fit connection, bolts, rivets, welding, adhesive or epoxy. Once attached to the underside of a desktop with the brackets 404, adjustable keyboard tray 400 operates in the same manner as adjustable keyboard tray 100, providing both tilt adjustment and horizontal adjustment for keyboard platform 101. For example, keyboard platform 101 is slidable between a stored position completely underneath the desktop, and a protruding position out and down from a topside of the desktop.

The specific techniques for adjustable keyboard trays, including techniques described with respect to adjustable keyboard trays 100, 400 and desktop assembly 200, are merely illustrative of the general inventive concepts included in this disclosure as defined by the following claims.

What is claimed is:

1. An adjustable keyboard tray comprising:

a desk mount configured to secure the adjustable keyboard tray to a desktop;

a slide including a fixed rail attached to the desk mount and a slidable rail slidably mated with the fixed rail;

a keyboard platform mount attached to the slidable rail with a keyboard platform mount pivot; and a keyboard platform attached to the keyboard platform mount, the keyboard platform being slidable relative to the desk mount via the slide and tiltable relative to the slide via the keyboard platform mount pivot; and a tilt lock to fix a tilt setting of the keyboard platform relative to the slide, wherein the tilt lock includes a shaft extending through one of a plurality of holes in the keyboard platform mount and engaged with the slidable rail, each of the plurality of holes providing a different tilt setting for the keyboard platform.

2. The adjustable keyboard tray of claim 1, wherein the slidable rail includes a channel track to receive the fixed rail.

3. The adjustable keyboard tray of claim 1, wherein the slide allows an operator to apply a force to move the keyboard platform in a horizontal motion to locate the keyboard platform closer to or further away from the operator.

4. The adjustable keyboard tray of claim 1, wherein the desk mount is a first desk mount, the slide is a first slide, the keyboard platform mount is a first keyboard platform mount, and the keyboard platform mount pivot is a first keyboard platform mount pivot, the adjustable keyboard tray further comprising:

a second desk mount configured to secure the adjustable keyboard tray to the desktop;

a second slide attached to the second desk mount; and a second keyboard platform mount attached to the second slide with a second keyboard platform mount pivot, wherein the keyboard platform is attached to the second keyboard platform mount, wherein the first slide and the second slide operate in parallel for horizontal adjustments of the keyboard platform, and wherein the first keyboard platform mount pivot and the second keyboard platform mount pivot operate in parallel for tilt adjustments of the keyboard platform.

5. The adjustable keyboard tray of claim 1, wherein the desk mount includes a bracket with screw holes configured for attachment to an underside of the desktop.

6. The adjustable keyboard tray of claim 1, wherein the desk mount includes a clamp configured to engage an edge of the desktop.

7. The adjustable keyboard tray of claim 6, further comprising a clamp pad over a clamping surface of the clamp to protect a topside of the desktop from the clamp.

8. The adjustable keyboard tray of claim 1, further comprising a keyboard stop extending upwards proximate a rear edge of the keyboard platform.

9. The adjustable keyboard tray of claim 1, wherein the keyboard platform includes two keyboard platform sections joined with connecting plates that span a joint between the two keyboard platform sections along an underside of the keyboard platform.

10. An adjustable keyboard tray comprising:

a desk mount configured to secure the adjustable keyboard tray to a desktop;

a slide including a fixed rail attached to the desk mount and a slidable rail slidably mated with the fixed rail;

a keyboard platform mount attached to the slidable rail with a keyboard platform mount pivot;

a keyboard platform attached to the keyboard platform mount, the keyboard platform being slidable relative to the desk mount via the slide and tiltable relative to the slide via the keyboard platform mount pivot; and a tilt lock to fix a tilt setting of the keyboard platform relative to the slide, wherein the tilt lock includes a tilt locking knob including a threaded shaft extending through one of a plurality of holes in the keyboard platform mount and engaged with the slidable rail, each of the plurality of holes providing a different tilt setting for the keyboard platform.

11. The adjustable keyboard tray of claim 10, wherein the tilt locking knob is engaged with a threaded hole in the slidable rail.

12. A desktop assembly comprising:

a desktop; and an adjustable keyboard tray, the adjustable keyboard tray including:

a desk mount securing the adjustable keyboard tray to the desktop;

a slide including a fixed rail attached to the desk mount and a slidable rail slidably mated with the fixed rail;

a keyboard platform mount attached to the slidable rail with a keyboard platform mount pivot;

a keyboard platform attached to the keyboard platform mount, the keyboard platform being slidable relative to the desk mount and the desktop via the slide and tiltable relative to the slide and the desktop via the keyboard platform mount pivot; and a tilt lock to fix a tilt setting of the keyboard platform relative to the slide, wherein the tilt lock includes a shaft extending through one of a plurality of holes in the keyboard platform mount and engaged with the slidable rail, each of the plurality of holes providing a different tilt setting for the keyboard platform.

13. The desktop assembly of claim 12, wherein the keyboard platform is slidable between a stored position completely underneath the desktop, and a protruding position out and down from a topside of the desktop.

14. The desktop assembly of claim 12, wherein the shaft is a threaded shaft, and wherein the tilt lock includes a tilt locking knob including the threaded shaft extending through one of the plurality of holes in the keyboard platform mount and engaged with the slidable rail.

15. The desktop assembly of claim 12, wherein the desk mount is a first desk mount, the slide is a first slide, the keyboard platform mount is a first keyboard platform mount, and the keyboard platform mount pivot is a first keyboard platform mount pivot, the adjustable keyboard tray further comprising:

a second desk mount securing the adjustable keyboard tray to the desktop;

a second slide attached to the second desk mount; and a second keyboard platform mount attached to the second slide with a second keyboard platform mount pivot, wherein the keyboard platform is attached to the second keyboard platform mount, wherein the first slide and the second slide operate in parallel for horizontal adjustments of the keyboard platform, and wherein the first keyboard platform mount pivot and the second keyboard platform mount pivot operate in parallel for tilt adjustments of the keyboard platform.

16. The desktop assembly of claim 12, wherein the desk mount includes a bracket with screw holes, the desktop assembly further comprising screws through the screw holes into an underside of the desktop, thereby attaching the bracket to the underside of the desktop.

17. The desktop assembly of claim 12, wherein the desk mount includes a clamp engaging an edge of the desktop.

18. The desktop assembly of claim 17, further comprising a clamp pad over a clamping surface of the clamp to protect a topside of the desktop from the clamp.

* * * * *